US005262074A

United States Patent [19]

Erickson et al.

[11] Patent Number: 5,262,074

[45] Date of Patent: Nov. 16, 1993

[54] DRY FILM LUBRICANTS

[75] Inventors: Frank Erickson; David L. Folkins, both of Seattle, Wash.

[73] Assignee: International Lubricants, Inc., Seattle, Wash.

[21] Appl. No.: 886,370

[22] Filed: May 20, 1992

[51] Int. Cl.[5] ..... C10M 129/68; C10M 137/00

[52] U.S. Cl. ..... 252/49.003; 252/49.008; 252/56 R

[58] Field of Search ..... 252/48.6, 49.8, 56 R, 252/46.6

[56] References Cited

U.S. PATENT DOCUMENTS 3,740,333 6/1973 Hutchinson et al. ..... 252/48.6
4,152,278 5/1979 Bell ..... 252/56 S
4,925,581 5/1990 Erickson et al. ..... 252/48.6
4,970,010 11/1990 Erickson et al. ..... 252/48.6
4,978,465 12/1990 Sturwold ..... 252/48.6
5,023,312 6/1991 Erickson et al. ..... 252/49.8

*Primary Examiner*—Jacqueline V. Howard
*Attorney, Agent, or Firm*—Davis Wright Tremaine

[57] ABSTRACT

There is disclosed a dry film lubricant for use in metal stamping, fabricating and forming operations. The dry film lubricant comprises a wax component suspended in an aqueous solvent. The wax component comprises a saturated wax ester having a carbon chain length from about 28 to about 44 carbons atoms in length surrounding an ester bond. The unsaturated component comprises a phosphite adduct friction modifier and an unsaturated vegetable oil or modified unsaturated vegetable oil.

11 Claims, No Drawings

DRY FILM LUBRICANTS

TECHNICAL FIELD OF THE INVENTION

The present invention relates to a dry film lubricant for use in metal stamping, fabricating and forming operations. The dry film lubricant comprises a wax component suspended in an aqueous solvent.

BACKGROUND OF THE INVENTION

Lubricants are generally employed in various metal working operations and fabrications. Such operations include rolling, forging, blanking, bending, stamping, drawing, cutting, punching, spinning, bending, stretch forming, extruding, coining, hobbing, swaging, and the like. In the automotive and appliance fields, the term "stamping" is used as a broad term to cover all press working operations on sheet metal, which operations may be further categorized as cutting, drawing, or coining.

Metal working or fabricating lubricants, particularly dry film lubricants, facilitate these operations by reducing friction between the metal being worked and the tooling employed for that process. This reduces power required for a particular operation, reduces wear on the surfaces of tooling that operate on metals, and prevents sticking between metal being worked and tooling operating thereon, or between metal pieces during storage, handling and operations. A dry film lubricant can further provide corrosion prevention properties to metal being worked and tooling metal. In automotive and appliance applications, prevention of sticking between metal pieces and between such pieces and work elements is of extreme importance. In aerospace and airplane applications it is of extreme importance to fabricate metal pieces without signs of seizing or galling.

In some metal working processes, including automotive and appliance applications, coils or rolls of steel, in particular cold rolled or galvanized steel sheets, are cut into pieces, called blanks, which are stamped or drawn to produce desired parts. Such automotive parts, formed by stamping or drawing, include fenders, hoods, deck lids, quarter panels, oil pans, fuel tanks, floor panels, inner and outer door panels, and the like. Appliance parts, formed by stamping and drawing, include washer tops, dryer tops, washer and dryer fronts, top and front lids, dryer tumblers and the like. Prior to use of a dry film lubricant, normal procedures were to apply an oil at the mill (e.g., steel mill) to such coils and rolls as a rust preventative prior to shipping to the processing site. Before the metal forming operation, rust preventative oil is removed and a dry film lubricant is added.

More recently, use of rust preventative oils has declined and dry film lubricants are applied directly at the steel mill to act as both a lubricant and as a rust preventative agent. Such agents, now in use in automotive and appliance industries, are hydrocarbon based compositions containing sulfurized or waxy components. Such agents are generally liquid at ambient room temperature. These compositions tend to drain off the metal surfaces, creating maintenance problems and further tend to be or become unevenly distributed on metal surfaces due to capillary forces. Properties of rust prevention and drawing frictional reduction both depend, in large part, on uniformity of lubricant films. A tendency to puddle on a metal surface diminishes a lubricant's potential for providing protection from rust and in reducing friction during a fabricating or forming operation. Moreover, greater and more uniform friction reduction properties over the entire metal surface will permit more severe fabricating and forming process to occur without signs of seizing or galling. Further, with current hydrocarbon-based compositions, housekeeping and cleanliness are difficult to maintain because such compositions leak onto tooling surfaces, contaminate floor trenches and waste treatment streams, volatilize into air and create dermatitis problems on a worker's skin.

Further, metal working operations, such as metal tube bending or stretch forming requires an extreme pressure lubricant that is in a paste form and can be applied manually or mechanically to tubes and the like. An extreme pressure lubricant should be capable of being removed from the metal once the tube bending or stretch forming operation is completed. Moreover, it is desirable to be able to dispose of the lubricant as a non-hazardous waste.

Therefore, there is a need in the art for a dry film lubricant that can eliminate or reduce many of these problems.

SUMMARY OF THE INVENTION

The present invention provides a dry film lubricant having a wax component comprising a saturated component and an unsaturated component. The wax component is added to an aqueous miscible solvent for application to a metal surface. The saturated component comprises a saturated wax ester having a carbon chain length from about 28 to about 44 carbons atoms in length surrounding an ester bond. The unsaturated component comprises a phosphite adduct friction modifier and an unsaturated vegetable oil or modified unsaturated vegetable oil.

The wax component is heated above its solid to liquid transition temperature (about 55° C. to about 80° C.) and suspended in a solvent as a 10% to 40% (w/v) suspension. Preferably, about 20% of the wax component is added to a short chain alcohol solvent (e.g., isopropyl alcohol).

The saturated wax ester is formed by reacting approximately equal amounts (w/w) of a saturated long chain fatty alcohol (preferably 1-octadecanol) and a saturated long chain fatty acid (e.g., stearic acid). The saturated component comprises from about 30% to about 70% of the wax component by weight. Preferably, the saturated component comprises about 50% of the wax component by weight.

The unsaturated component comprises lubricant additive unsaturated vegetable oil or modified unsaturated vegetable oil and friction modifier. The unsaturated component comprises from about 30% to about 70% of the wax component by weight. Preferably, the unsaturated component comprises about 50% of the wax component by weight.

The friction modifier is present at a range of from about 1% to about 8% (by weight) of the wax component. The unsaturated lubricant additive vegetable oil or modified vegetable oil is present at a range of from about 29% to about 69% (by weight) of the wax component. The friction modifier is a phosphite adduct of an unsaturated vegetable oil or an unsaturated modified vegetable oil formed by the reaction of the vegetable oil or modified vegetable oil and a compound of the formula:

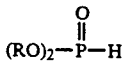

wherein R is H, $C_{1-12}$ alkyl, $C_{1-12}$ aryl, $C_{1-12}$ alkaryl, $C_{1-12}$ arakyl, or cyclo $C_{4-12}$ alkyl. The unsaturated vegetable oil or modified vegetable oil are selected from the group consisting of triglyceride vegetable oils, vegetable oil wax esters, telomerized triglyceride vegetable oils, and combinations thereof.

The present invention further comprises a forming paste to provide extreme pressure lubricity for metal working applications such as metal tube bending, stretch forming and similar extreme operations. The inventive metal forming paste comprises from about 10% to about 30% (by weight) of a solvent degreaser, from about 10% to about 30% (by weight) of a wax component (as defined herein), and the remainder is water.

DETAILED DESCRIPTION OF THE INVENTION

The present invention is a dry film lubricant comprising a wax component suspended in an aqueous miscible solvent capable of evaporation. The amount of suspended solids (i.e., wax component) is from about 10% to about 40% by weight. Preferably, there is about 20% wax component suspended in solvent, or a 1:4 ratio of wax component to solvent. The greater the solids amount suspended in the solvent, the faster the drying time. However, higher wax component solids concentrations make spray applications more difficult and the higher the solids concentration the more difficult control to achieve a uniform coating on the metal piece to be fabricated. Therefore an appropriate range of solids is from about 10% to about 40% by weight.

The solvent is selected from the group consisting of a short chain alcohol, such as a $C_{1-5}$ alcohol, water, a weak organic acid in water (e.g., citric, malic or oxalic acids), and combinations thereof. Preferred solvents include, for example, methanol, ethanol, 1-propanol, isopropyl alcohol, 1-butanol, isobutyl alcohol, 1-pentanol, combinations thereof, and the like. Most preferably, the solvent is isopropyl alcohol.

The wax component is made up of a saturated component and an unsaturated component. The amount of saturated component is from about 30% to about 70% by weight. Preferably, the amount of saturated component is about 50% by weight of the total wax component. The amount of unsaturated component is from about 30% to about 70% by weight. Preferably, the amount of unsaturated component is about 50% by weight of the total wax component.

The saturated wax ester is formed by reaction approximately equal amounts (w/w) of a saturated long chain fatty alcohol (preferably 1-octadecanol) and a saturated long chain fatty acid (e.g., stearic acid). The saturated wax ester is from about 28 to about 44 carbon atoms in length with the ester group located at least 12 carbon atoms from either end of the saturated ester. Preferably, the saturated wax ester is formed by reaction of a $C_{14-22}$ fatty alcohol and a $C_{14-22}$ fatty acid. Most preferably the saturated wax ester is the reaction product of 1-octadecanol and stearic acid.

The unsaturated component comprises a friction modifier and a lubricant additive. The friction modifier is a phosphite adduct of an unsaturated vegetable oil or an unsaturated modified vegetable oil formed by the reaction of the vegetable oil or modified vegetable oil and a compound of the formula:

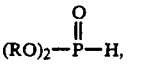

wherein R is H, $C_{1-12}$ alkyl, $C_{1-12}$ aryl, $C_{1-12}$ alkaryl, $C_{1-12}$ arakyl, or cyclo $C_{4-12}$ alkyl. Preferably, R is $C_{4-8}$ alkyl, $C_{4-8}$ aryl, $C_{4-8}$ alkaryl, $C_{4-8}$ arakyl, or cyclo $C_{4-8}$ alkyl. Most preferably R is n-butyl. Phosphite adducts of unsaturated vegetable oils and unsaturated wax esters of vegetable oils are described in U.S. Pat. No. 4,970,010, the disclosure of which is incorporated by reference herein.

The lubricant additive of the unsaturated component of the wax component is selected from the group consisting of unsaturated vegetable oils, wax esters of unsaturated vegetable oils, telomerized unsaturated vegetable oils, and combinations thereof. Wax esters of unsaturated vegetable oils and telomerized vegetable oils are called "modified vegetable oils" herein when made into a phosphite adduct. Wax esters of unsaturated vegetable oils are described in U.S. Pat. No. 4,152,278, the disclosure of which is incorporated by reference herein. Unsaturated vegetable oils are a triester of three (predominantly) unsaturated long chain fatty acids bound to a glycerol backbone by ester bonds. The fatty acids are from about 12 to about 26 carbon atoms in length and are predominantly monounsaturated and not more than triunsaturated for at least 90% of the fatty acids. Examples of such unsaturated vegetable oils include, for example, rapeseed oil, meadowfoam oil, crambe oil, soya bean oil, peanut oil, safflower oil, sunflower seed oil, linseed oil, olive oil, corn oil, coconut oil, palm oil and the like. Telomerized unsaturated vegetable oils are described in U.S. patent application Ser. No. 07/596,820, filed on Oct. 12, 1990, the disclosure of which is incorporated by reference herein. Briefly, telomerized vegetable oils are the product of a process comprising heating an unsaturated vegetable oil (as defined herein) for at least five hours at a temperature of from about 200° C. to about 400° C. in a non-oxidizing atmosphere in the presence of a trace amount of water as a catalyst. The telomer oil differs from its unsaturated vegetable oil starting product by the presence of a plurality of aliphatic rings, polymerization, higher viscosity, lower iodine number and greater thermal oxidative stability.

The dry film lubricant is useful to provide extreme pressure lubricity, when applied to the metal piece for fabrication, even during demanding fabricating and forming processes, and accomplished without seizing or galling of the formed metal piece. The dry film lubricant is applied to clean, dry metal piece (also called base stock) prior to fabrication. The long term effect of use of such a dry film lubricant is a better surface finish, extended tool life, biodegradable product, and application to all metal surfaces.

Preferably, the dry film lubricant is applied to a metal piece before forming. Further benefits are achieved if a tool and dye lubricant is applied to the tool surface. Preferably, a tool and dye lubricant comprises a mixture of solid lubricants including molybdenum disulfide. The tool and dye lubricant is preapplied to tooling, dyes, mandrels and the like to work in conjunction with a dry film lubricant applied to each metal piece.

The present invention further comprises a forming paste to provide extreme pressure lubricity for metal working applications such as metal tube bending, stretch forming and similar extreme operations. The inventive metal forming paste comprises from about 10% to about 30% (by weight) of a solvent degreaser, from about 10% to about 30% (by weight) of a wax component (as defined herein), and the remainder is water. Preferably, the forming paste comprises about 20% (by weight) solvent degreaser, about 20% (by weight) wax component and about 60% tap water. Solvent degreasers are surfactant-containing aqueous formulations containing additional quantities of citric acid or other weak organic acids (e.g., malic acid or oxalic acid). A preferred solvent a cold temperature degreaser and weak organic acid in aqueous solution, such as Solterge II ® (Joy Detergent, Ft Worth Tex.).

A dry film lubricant can be made, for example, by weighing out each of the saturated fatty alcohol and saturated fatty acid to form the saturated wax ester (or, alternatively, obtaining a saturated wax ester), heating the saturated materials just beyond their solid to liquid transition temperature (about 55° C. to about 80° C.) to form the wax ester and adding the unsaturated materials to form the wax component in a liquid state. The wax component (in a liquid state) is added to the short chain alcohol solvent (heated to at least the wax component transition temperature), and this mixture is cooled to room temperature. Solids remain suspended in the dry film lubricant. This material is shaken before spray application to a metal surface for uniform application.

The forming paste, according to the present invention, is made, for example, by obtaining the wax component in a liquid state (as described herein) and adding this to heated (to at least the transition temperature of the wax component) solvent degreaser and mixed. Hot water (at least 60° C.) is added to the mixture. The mixture is cooled for at least five hours (preferably 5–15 hours) with constant agitation to form a uniform paste at room temperature.

EXAMPLE

This example illustrates the manufacture of a 5 kg batch of a dry film lubricant. Approximately 250 g of 1-octadecanol (ALFOR ® 18 Alcohol NF, Vista Chemical, Houston Tex.) and 250 g of stearic acid (Hystrene ®9718, Humko, Memphis Tenn.) were added to a suitable contained and heated to about 74° C. of a heated surface (e.g., hot plate). About 30 g of an N-butyl phosphite adduct of a rapeseed oil liquid wax ester (Erucical EG-20 ®, Calgene Chemical Co. Des Plaines, Ill.) was added to the heated mixture. About 470 g of a rapeseed oil liquid wax ester was also added to the heated mixture. The mixture was thoroughly mixed. This was a 1 kg batch of wax component.

Approximately 4 kg of isopropyl alcohol was heated to at least 55° C. to be maintained above the transition temperature of the wax component. The wax component was poured into the heated batch of isopropyl alcohol and thoroughly mixed. The ratio of addition was one part wax component to four parts isopropyl alcohol. The heated dry film lubricant was added to applicator bottles while heated and allowed to cool in the applicator bottles. At room temperature the dry film lubricant is a partly suspended solid that can be uniformly suspended with shaking.

What is claimed is:

1. A dry film lubricant comprising from about 10% to about 40% by weight of a wax component in a solvent, wherein the wax component comprises a saturated wax ester having a carbon chain length of from about 28 to about 44 carbon atoms in length, a phosphite adduct friction modifier and a lubricant additive, wherein the phosphite adduct friction modifier is a phosphite adduct of an unsaturated vegetable oil or an unsaturated modified vegetable oil formed by the reaction of an unsaturated vegetable or an unsaturated modified vegetable oil and a compound of the formula:

$$(RO)_2-\overset{\overset{\displaystyle O}{\|}}{P}-H$$

wherein R is H, $C_{1-12}$alkyl, $C_{1-12}$aryl, $C_{1-12}$alkaryl, $C_{1-12}$arakyl, or cyclo $C_{4-12}$alkyl, and wherein the lubricant additive is selected from the group consisting of unsaturated vegetable oils, wax esters of unsaturated vegetable oils, telomerized unsaturated vegetable oils, and combinations thereof.

2. The dry film lubricant of claim 1 wherein the aqueous solvent is selected from the group consisting of water, citrate buffer, malate buffer, oxalate buffer, methanol, ethanol, 1-propanol, isopropyl alcohol, 1-butanol, isobutyl alcohol, 1-pentanol, and combinations thereof.

3. The dry film lubricant of claim 2 wherein the aqueous solvent is isopropyl alcohol.

4. The dry film lubricant of claim 1 wherein the lubricant additive is a wax ester of an unsaturated vegetable oil.

5. The dry film lubricant of claim 3 wherein R is $C_{4-8}$alkyl, $C_{4-8}$aryl, $C_{4-8}$alkaryl, $C_{4-8}$arakyl, or cyclo $C_{4-8}$alkyl.

6. The dry film lubricant of claim 5 wherein R is n-butyl.

7. The dry film lubricant of claim 1 wherein the saturated wax ester comprises from about 30% to about 70% (by weight) of the wax component.

8. A forming paste comprising from about 10% to about 30% (by weight) of a solvent degreaser, from about 10% to about 30% (by weight) of a wax component, wherein the wax component comprises a saturated wax ester having a carbon chain length of from about 28 to about 44 carbon atoms in length, a phosphite adduct friction modifier and a lubricant additive, and water, wherein the phosphite adduct friction modifier is a phosphite adduct of an unsaturated vegetable oil or an unsaturated modified vegetable oil formed by the reaction of an unsaturated vegetable or an unsaturated modified vegetable oil and a compound of the formula:

$$(RO)_2-\overset{\overset{\displaystyle O}{\|}}{P}-H$$

wherein R is H, $C_{1-12}$alkyl, $C_{1-12}$aryl, $C_{1-12}$alkaryl, $C_{1-12}$arakyl, or cyclo $C_{4-12}$alkyl, and wherein the lubricant additive is selected from the group consisting of unsaturated vegetable oils, wax esters of unsaturated vegetable oils, telomerized unsaturated vegetable oils, and combinations thereof.

9. The forming paste of claim 8 wherein the lubricant additive is a wax ester of an unsaturated vegetable oil.

10. The forming paste of claim 8 wherein R is $C_{4-8}$alkyl, $C_{4-8}$aryl, $C_{4-8}$alkaryl, $C_{4-8}$arakyl, or cyclo $C_{4-8}$alkyl.

11. The forming paste of claim 10 wherein R is n-butyl.

* * * * *